US009845639B2

(12) United States Patent
Chen

(10) Patent No.: US 9,845,639 B2
(45) Date of Patent: Dec. 19, 2017

(54) BLIND BODY BRAKE MECHANISM FOR NON PULL CORD WINDOW BLIND

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 0 days.

(21) Appl. No.: 15/243,145

(22) Filed: Aug. 22, 2016

(65) Prior Publication Data

US 2017/0058599 A1 Mar. 2, 2017

(30) Foreign Application Priority Data

Sep. 2, 2015 (TW) ..... 104128997 A

(51) Int. Cl.
*E06B 9/322* (2006.01)

(52) U.S. Cl.
CPC ..... *E06B 9/322* (2013.01); *E06B 2009/3222* (2013.01)

(58) Field of Classification Search
CPC .. E06B 9/322; E06B 2009/3222; E06B 9/324; E06B 9/325
See application file for complete search history.

(56) References Cited

U.S. PATENT DOCUMENTS 6,024,154 A * 2/2000 Wang ..... E06B 9/322 160/168.1 R
6,575,223 B1 * 6/2003 Chung ..... E06B 9/32 160/170
7,311,134 B2 * 12/2007 Cheng ..... E06B 9/322 160/170
7,331,370 B1 * 2/2008 Militello ..... E06B 9/322 160/170
7,575,036 B2 * 8/2009 Cheng ..... E06B 9/322 160/170
2006/0175023 A1 * 8/2006 Cheng ..... E06B 9/322 160/170
2007/0151676 A1 * 7/2007 Lin ..... E06B 9/262 160/170
2008/0000592 A1 * 1/2008 Huang ..... E06B 9/322 160/170
2008/0277076 A1 * 11/2008 Cheng ..... E06B 9/322 160/167 R (Continued)

*Primary Examiner* — Blair M Johnson
(74) *Attorney, Agent, or Firm* — Muncy, Geissler, Olds & Lowe, P.C.

(57) ABSTRACT

A window body brake mechanism for non pull cord window blind includes a rolling-up unit including two coil spring winding wheels meshed together and a coil spring connected between the coil spring winding wheels, a transmission unit including two transmission gears respectively meshed with the coil spring winding wheels and two transmission cords respectively connected to the transmission gears, and a brake unit including an operating button having a braking portion disposed between the two coil spring winding wheels and so configured that when the operating button is operated into a press position, the braking portion is released from the coil spring winding wheels for allowing synchronous rotation of the coil spring winding wheels; when the operating button is operated into a release position, the braking portion is engaged with the coil spring winding wheels to stop the coil spring winding wheels from rotation.

5 Claims, 9 Drawing Sheets

(56) References Cited

U.S. PATENT DOCUMENTS

2008/0314531 A1* 12/2008 Cheng ..... E06B 9/322
160/192
2010/0206492 A1* 8/2010 Shevick ..... E06B 9/30
160/170

* cited by examiner

BLIND BODY BRAKE MECHANISM FOR NON PULL CORD WINDOW BLIND

BACKGROUND OF THE INVENTION

1. Field of the Invention

The present invention relates to window blind technology, and more particularly to a blind body brake mechanism for non pull cord window blind.

2. Description of the Related Art

Commercial window blinds can be classified into pull-cord window blinds and non pull cord window blinds. A pull-cord window blind uses a pull cord for pulling by a user to move the blind between an extended status and a received status. However, except the drawbacks of laborious operation and poor positioning effect, the neck of a young child playing around a pull-cord window blind is likely to be caught up by the exposed pull cord of the window blind generated choking, resulting in a choking hazard. A non pull cord window blind allows a user to pull down or lift the bottom rail, enabling the blind body to be extended out or received subject to the control of a control mechanism. However, the control mechanisms of conventional non pull cord window blinds commonly have a complicated structure and can simply provide the blind body with a limited transmission effect.

SUMMARY OF THE INVENTION

The present invention has been accomplished under the circumstances in view. It is the main object of the present to provide a blind body brake mechanism for non pull cord window blind, which has the advantages of simple structure and ease of operation and provides the blind body with a good braking effect.

To achieve this and other objects of the present invention, a blind body brake mechanism comprises a casing, a rolling-up unit, a transmission unit, and a brake unit. The rolling-up unit comprises two coil spring winding wheels rotatably mounted in the casing and meshed with each other, and a coil spring connected between the two coil spring winding wheels. The transmission unit comprises two transmission gears rotatably mounted in the casing and respectively meshed with one respective coil spring winding wheel, and two transmission cords each having one end thereof respectively connected to one respective transmission gear. The brake unit comprises an operating button mounted in the casing and a return spring. The operating button comprises a braking portion disposed between the two coil spring winding wheels. The return spring is set between the casing and the operating button and adapted for providing an elastic restoring force to the operating button.

Thus, when press the operating button, the braking portion of the operating button is released from the two coil spring winding wheels for allowing the two coil spring winding wheels to be rotated synchronously. At this time, the blind body can be extended out or received. When release the pressure from the operating button, the braking portion of the operating button is forced by the return spring into engagement with the two coil spring winding wheels to stop the coil spring winding wheels from rotation, achieving positioning of the blind body.

Other advantages and features of the present invention will be fully understood by reference to the following specification in conjunction with the accompanying drawings, in which like reference signs denote like components of structure.

DETAILED DESCRIPTION OF THE INVENTION

Figure 1:
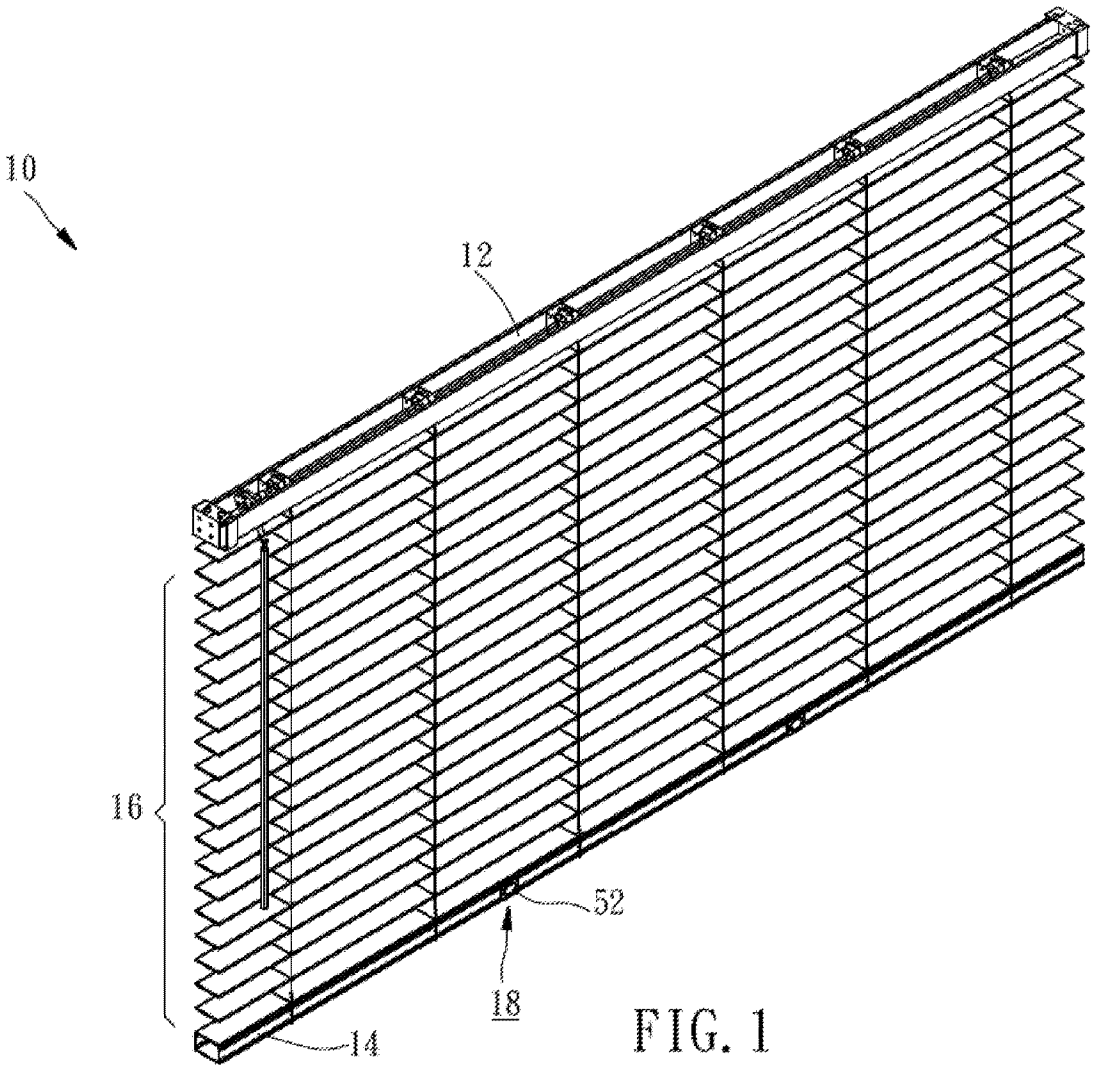
FIG. 1 is an elevational extended-out view of a blind body brake mechanism incorporated non pull cord window blind in accordance with the present invention.
Figure 2:
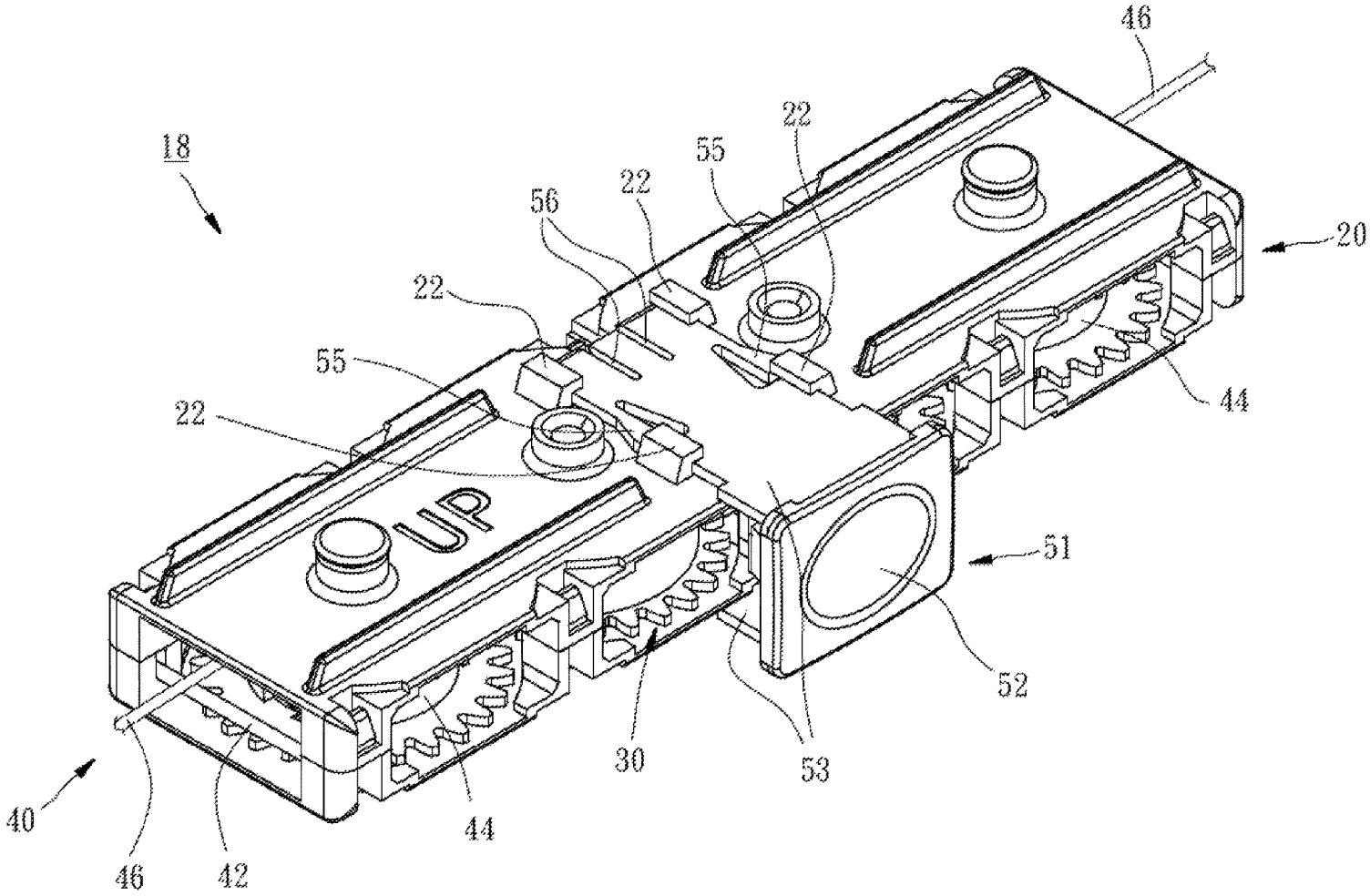
FIG. 2 is an oblique top elevational view of the blind body brake mechanism in accordance with the present invention.
Figure 4:
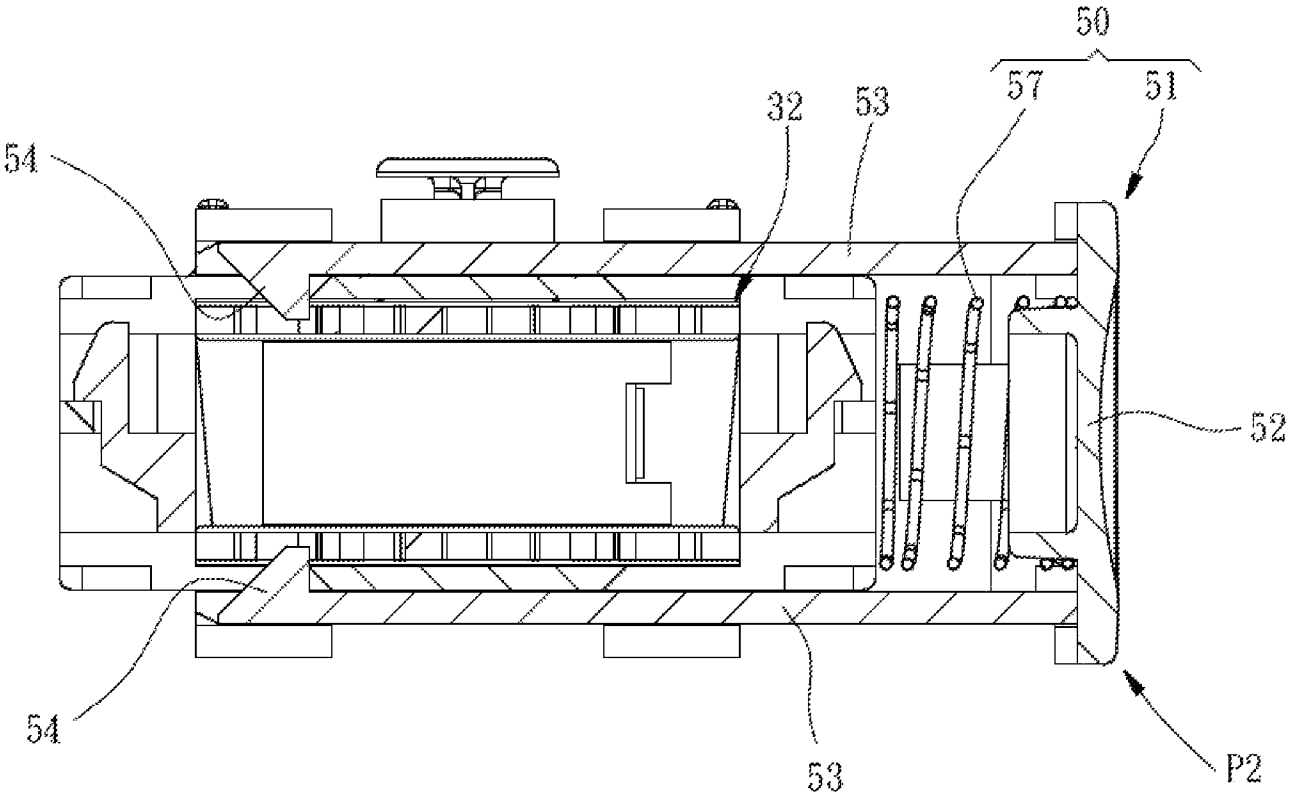
FIG. 4 is a sectional view of the present invention, illustrating the operating button in the release position.

Referring to FIG. 1, a blind body brake mechanism 18 is used in a non pull cord window blind 10 in accordance with the present invention. As illustrated, the non pull cord window blind 10 comprises a top rail 12, an opposing bottom rail 14, and blind body 16 coupled between the top rail 12 and the bottom rail 14. Referring to FIG. 2 and FIG. 4, the blind body brake mechanism 18 of the present invention comprises a casing 20, a rolling-up unit 30, a transmission unit 40, and a brake unit 50.

The casing 20 is mounted in the bottom rail 14, comprising two pairs of guide portions 22 respectively located on each of opposing top and bottom walls thereof.

Figure 3:
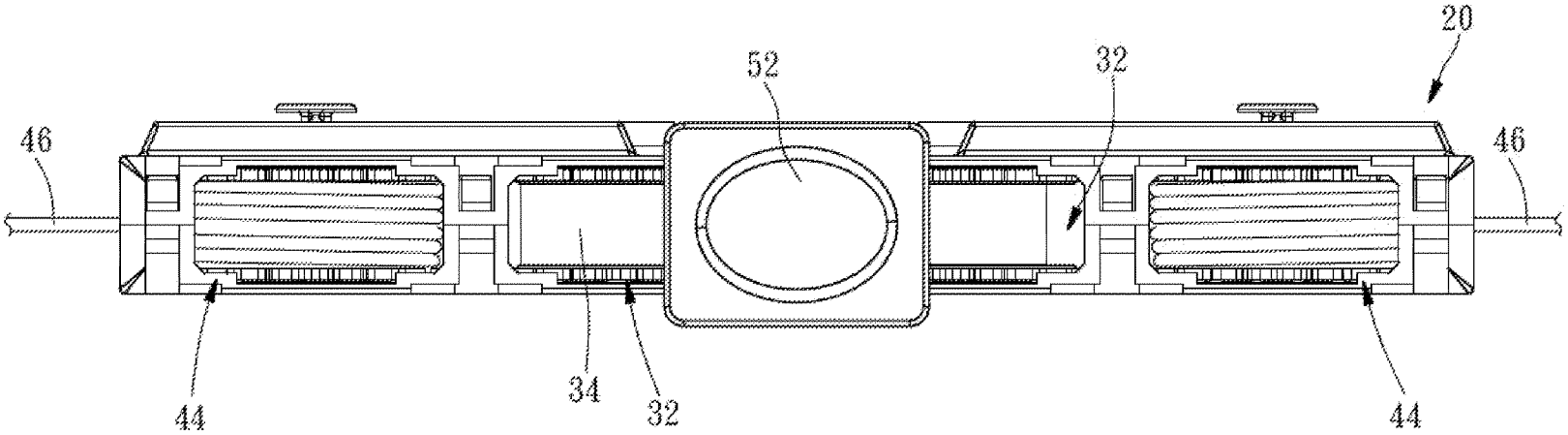
FIG. 3 is a front view of the blind body brake mechanism in accordance with the present invention.

The rolling-up unit 30 comprises two coil spring winding wheels 32, a coil spring 34 as shown in FIG. 3. The two coil spring winding wheels 32 are rotatably mounted in the casing 20 and meshed with each other. The coil spring 34 has two opposite ends thereof respectively connected to the two coil spring winding wheels 32, enabling the two coil spring winding wheels 32 to be rotated synchronously.

Figure 5:
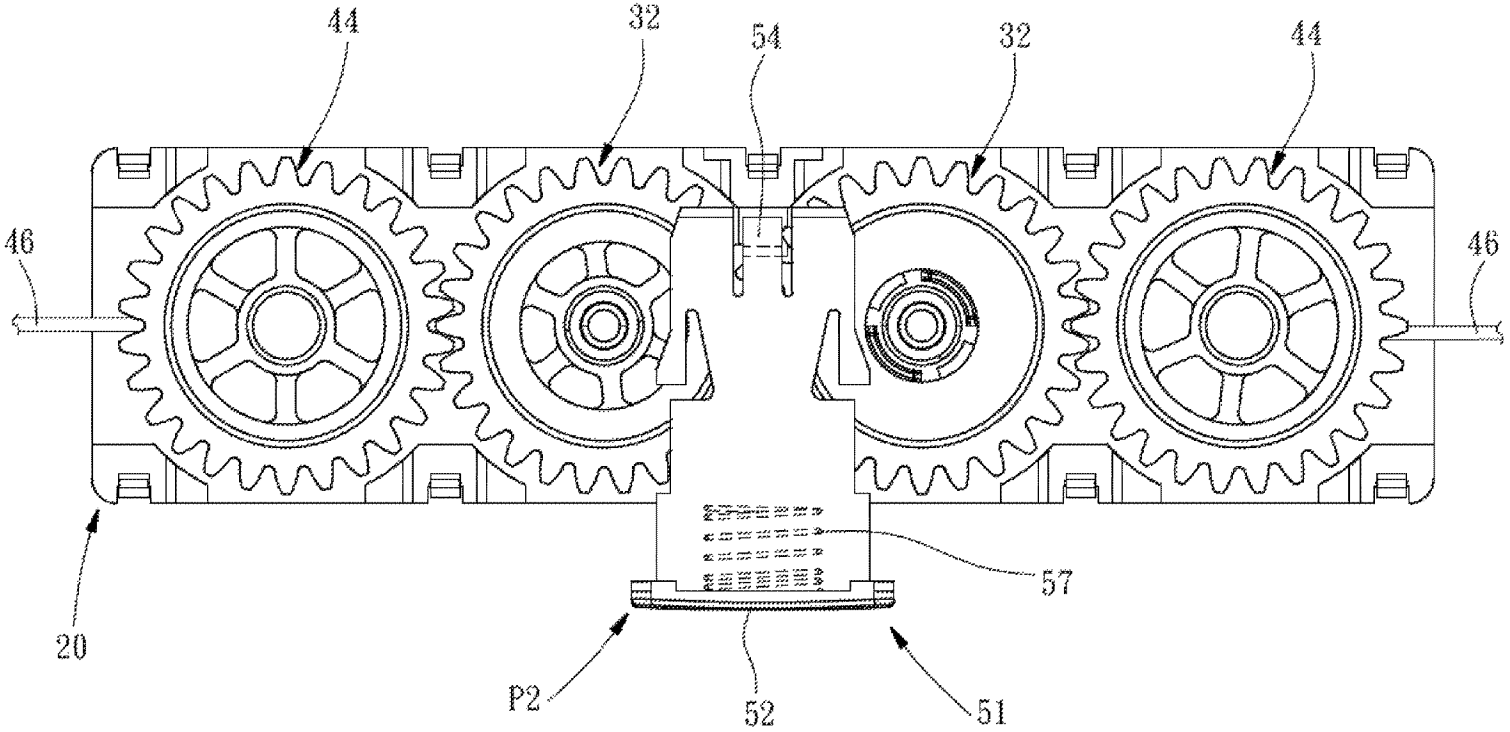
FIG. 5 is a top view of the present invention, illustrating the operating button in the release position.

The transmission unit 40 comprises two guide rods 42, two transmission gears 44, and two transmission cords 46 as shown in FIG. 2 and FIG. 5. The two guide rods 42 are respectively rotatably mounted in two opposite end of the casing 20. The two transmission gears 44 are rotatably mounted inside the casing 20 and respectively meshed with one respective coil spring winding wheel 32, so that the transmission gears 44 can be synchronously rotated with the respective coil spring winding wheels 32. The transmission cords 46 each have respective opposite ends thereof respectively connected to the top rail 12 and the respective transmission gears 44 so that on the one hand the transmission cords 46 can be pulled out by the bottom rail 14, and on the other hand, the transmission cords 46 can be rolled up by the respective transmission gears 44. Further, the transmission cords 46 are respectively peripherally abutted against the respective guide rods 42 so that when the transmission cords 46 are being let off or rolled up, they can be moved back and forth along the axial direction of the respective guide rods 42, enhancing the agility and smoothness of the movement.

The brake unit 50 comprises an operating button 51. The operating button 51 comprises a press portion 52, two opposite suspension arms 53, two opposite braking portions 54, and two opposite pairs of stop blocks 55. The suspension arms 53 each have one end connected to the press portion 52 and an opposite end provided with two spaced slits 56. The braking portions 54 are respectively located at a respective one end of one respective suspension arm 53 remote from the press portion 52 and between the associating two slits 56. The stop blocks 55 are respectively located at the suspension arms 53 at two opposite lateral sides. In installation, the two suspension arms 53 are respectively inserted in between the respective pairs of guide portions 22 of the casing 20, enabling the operating button 51 to be moved between a press position P1 (see FIG. 6 and FIG. 7) and a release position P2 (see FIG. 4 and FIG. 5). After installation, the press portion 52 of the operating button 51 is exposed to the outside through an opening (not shown) in the bottom rail 14 for pressing by the user, and, the braking portions 54 of the operating button 51 are disposed between the two coil spring winding wheels 32. When the operating button 51 is in the press position P1 shown in FIG. 6 and FIG. 7, the braking portions 54 of the operating button 51 is released from the coil spring winding wheels 32. When the operating button 51 is in the release position P2 shown in FIG. 4 and FIG. 5, the braking portions 54 of the operating button 51 is engaged in between the coil spring winding wheels 32. Further. the brake unit 50 comprises a return spring 57 stopped with two opposite ends thereof between the casing 20 and the press portion 52 of the operating button 51 to provide a restoring force to the operating button 51, keeping the operating button 51 in the release position P2.

Figure 6:
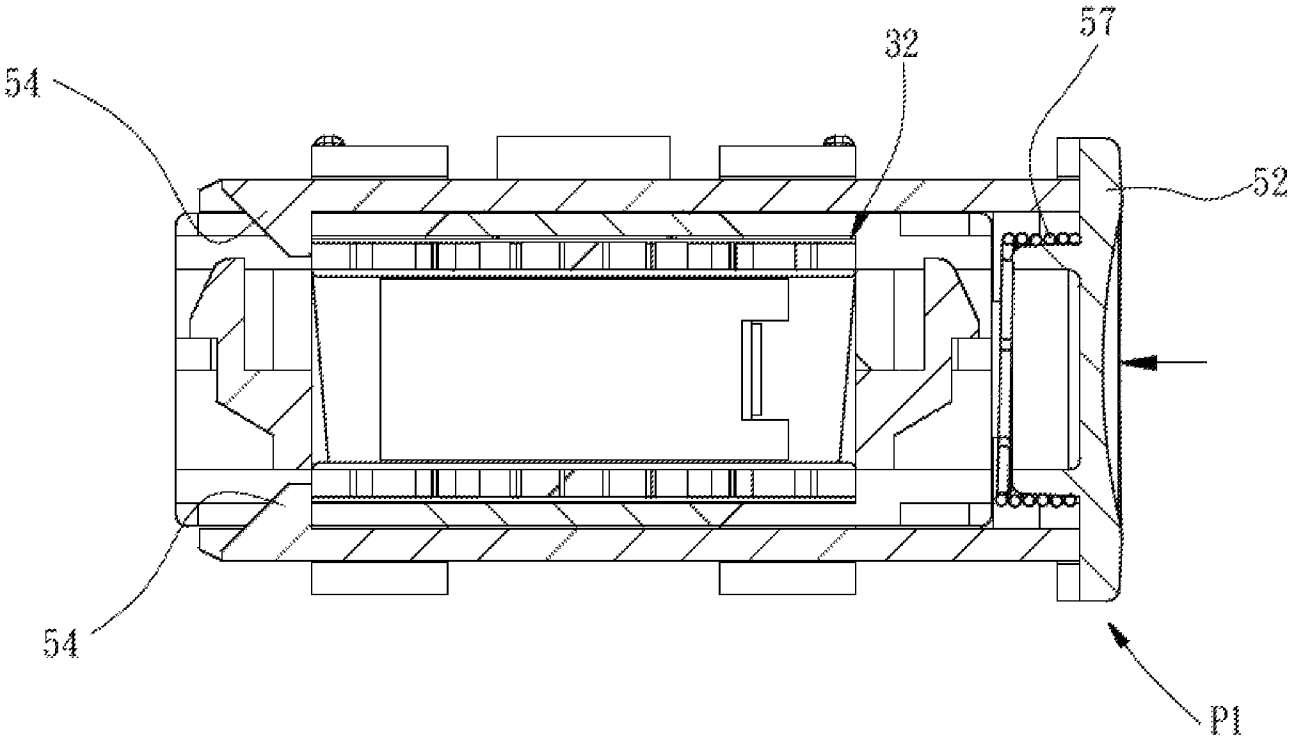
FIG. 6 is similar to FIG. 4, illustrating the operating button in the press position.
Figure 7:
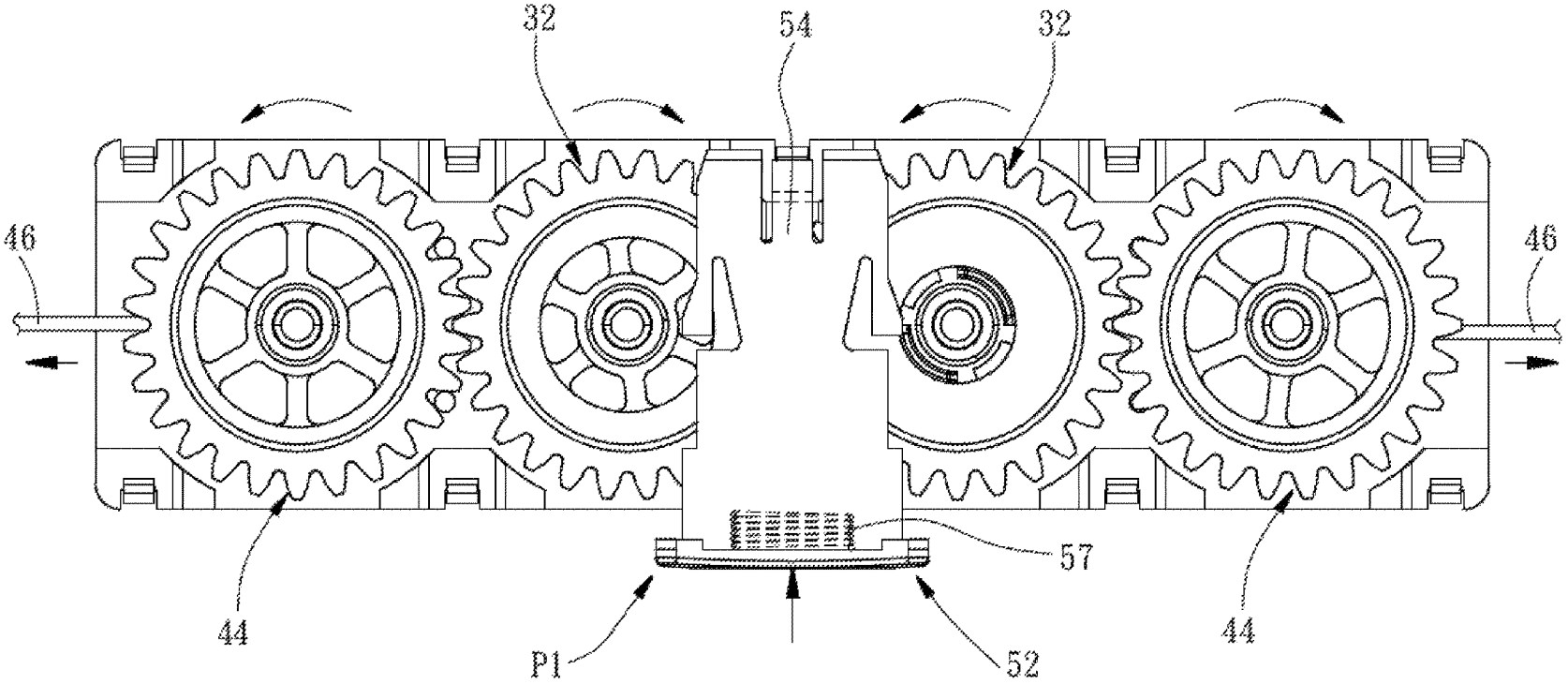
FIG. 7 is a top view of the present invention, illustrating a transmission cord extending operation during the operating button in the press position.

When wishing to extend out the blind body, apply a force to move the operating button 51 to the press position P1 shown in FIG. 6, releasing the braking portions 54 of the operating button 51 from the coil spring winding wheels 32. At this time, the return spring 57 is compressed by the press portion 52 of the operating button 51 to store elastic potential energy. Thereafter, pull the bottom rail 14 downward to pull out the transmission cords 46. When the transmission cords 46 are being pulled out, the transmission gears 44 are rotated (see FIG. 7). During rotation of the transmission gears 44, the meshed coil spring winding wheels 32 are rotated, causing the coil spring 34 to be wound up from one coil spring winding wheel 32 onto the other coil spring winding wheel 32, thereby storing an elastic restoring force. Once the user releases the hand from the bottom rail 14 after the blind body 16 reached the desired extended position, the operating button 51 is immediately returned by the return spring 57 to the release position P2 shown in FIGS. 4 and 5, forcing the braking portions 54 of the operating button 51 into engagement between the two coil spring winding wheels 32. At this time, the coil spring winding wheels 32 are stopped from rotation, enabling the blind body 16 to be held in the extended condition as shown in FIG. 1.

Figure 8:
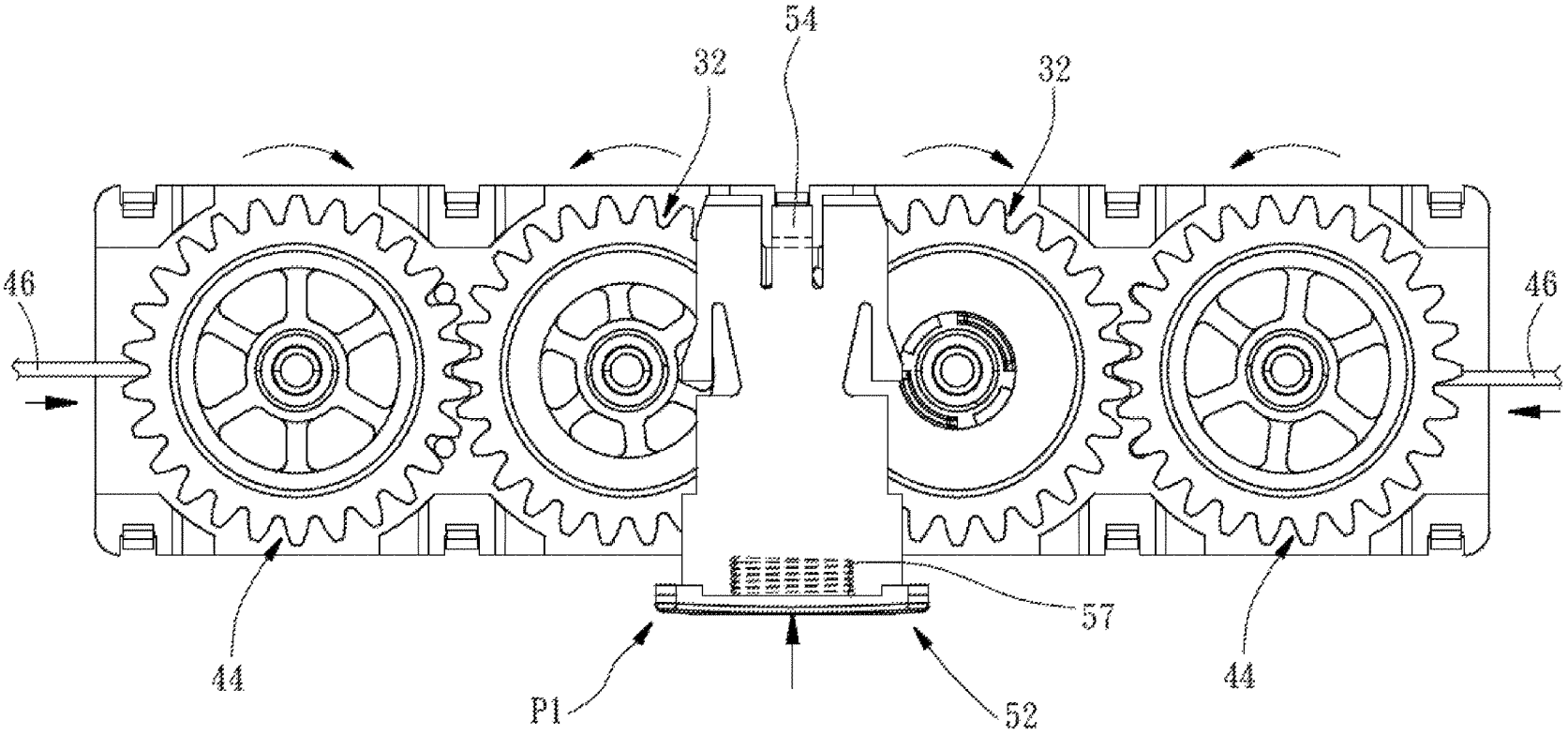
FIG. 8 is similar to FIG. 7, illustrating a transmission cord receiving operation during the operating button in the press position.
Figure 9:
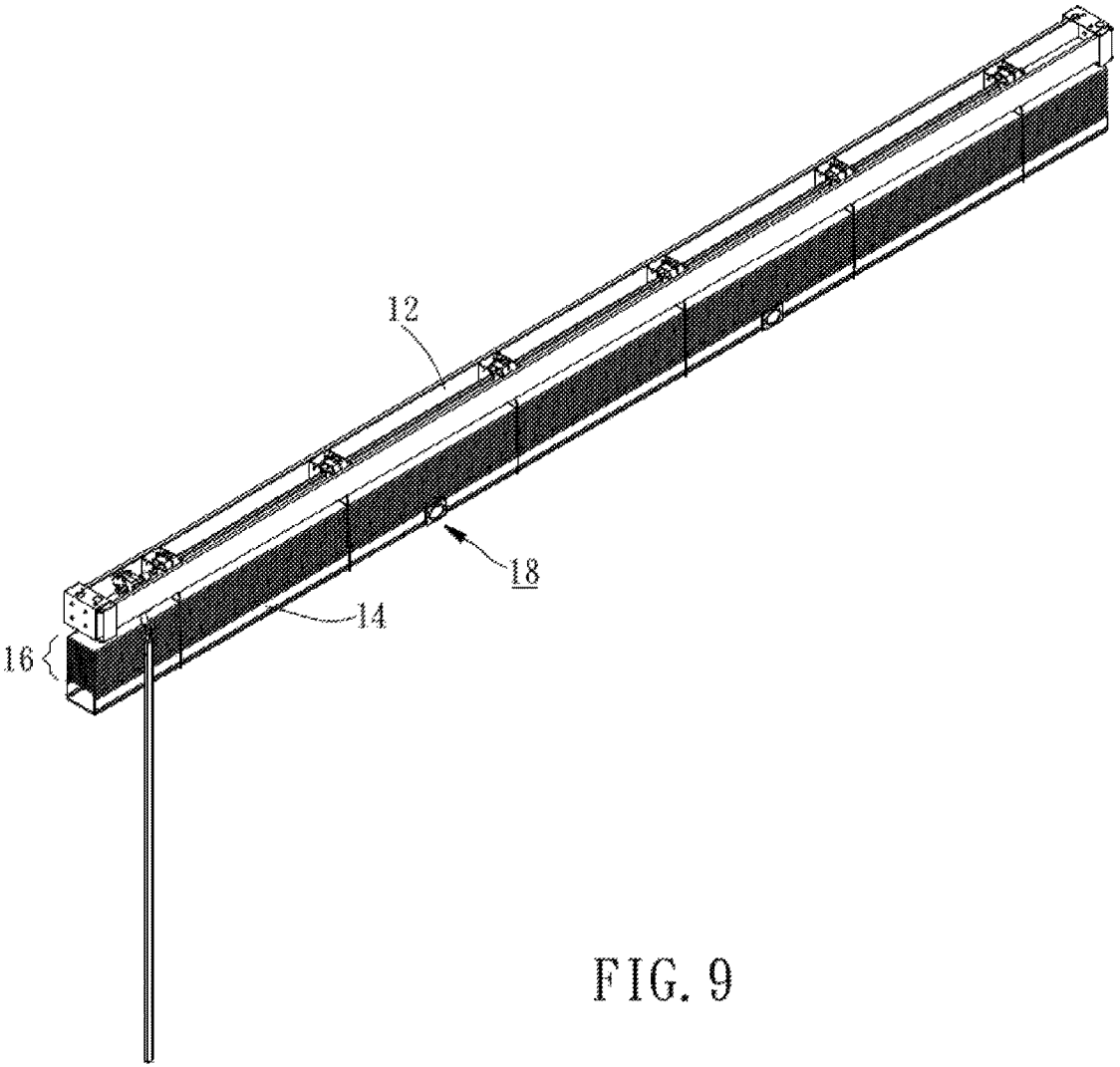
FIG. 9 is an elevational view illustrating the blind body brake mechanism incorporated non pull cord window blind in the received position in accordance with the present invention.

When wishing to receive the blind body 16, apply a force to the operating button 51 to move the operating button 51 to the press position P1 shown in FIG. 6, thereby releasing the braking portions 54 of the operating button 51 from the coil spring winding wheels 32. At this time, the return spring 57 is compressed by the press portion 52 of the operating button 51 to store elastic restoring force. Thereafter, the user can lift the bottom rail 14. During lifting of the bottom rail 14, the elastic restoring force of the coil spring 34 forces the two coil spring winding wheels 32 to rotate. During rotation of the coil spring winding wheels 32, the transmission gears 44 are rotated to roll up the respective transmission cords 46 (see FIG. 8). At this time, the transmission cords 46 are guided by the respective guide rods 42 and wound on the respective transmission gears 44 properly without causing interference or tangling, allowing the transmission cords 46 to be smoothly extended out in a next operation. After the blind body 16 reached the desired position, release the pressure from the operating button 51 and the lifting force from the bottom rail 14, enabling the operating button 51 to be returned by the return spring 57 to the release position P2 shown in FIGS. 4 and 5 where the braking portions 54 of the operating button 51 are engaged in between the two coil spring winding wheels 32. At this time, the coil spring winding wheels 32 are stopped from rotation, keeping the blind body 16 in the received condition shown in FIG. 9.

In conclusion, the blind body brake mechanism 18 of the invention uses the operating button 51 for controlling the rotation of the coil spring winding wheels 32 to achieve a good braking effect during the extending or receiving procedure of the blind body 16, and the guide rods 42 for guiding movement of the transmission cords 46 to let the transmission cords 46 to be smoothly and properly rolled up, and thus, the blind body 16 can be smoothly and steadily extended out or received.

What is claimed is:

1. A blind body brake mechanism for non pull cord window blind, comprising:

a casing;

a rolling-up unit comprising two coil spring winding wheels rotatably mounted in said casing and meshed with each other and a coil spring connected between said two coil spring winding wheels;

a transmission unit comprising two transmission gears rotatably mounted in said casing and respectively meshed with one respective said coil spring winding wheel and two transmission cords each having one end thereof respectively connected to one respective said transmission gear; and a brake unit comprising an operating button mounted in said casing and movable between a press position and a release position, and a return spring set between said casing and said operating button and adapted for holding said operating button in said release position, said operating button comprising a braking portion disposed between said two coil spring winding wheels in such a manner that when said operating button is in said press position, said braking portion of said operating button is released from said two coil spring winding wheels for allowing said two coil spring winding wheels to be rotated synchronously; when said operating button is in said release position, said braking portion of said operating button is engaged with said two coil spring winding wheels to stop said coil spring winding wheels from rotation, wherein said operating button comprises a press portion and a suspension arm, said suspension arm having one end thereof connected to said press portion and an opposite end thereof providing two spaced slits; said braking portion is disposed between said two slits.

2. The blind body brake mechanism as claimed in claim 1, wherein said casing comprises two opposing guide portions; said suspension arm is slidably coupled to said casing between said two guide portions; said return spring is mounted between said casing and said press portion of said operating button.

3. The blind body brake mechanism as claimed in claim 2, wherein said operating button further comprises two stop blocks mounted at two opposite lateral sides of said suspension arm, said stop blocks being respectively stopped against said guide portions of said casing when said operating button is in said release position.

4. The blind body brake mechanism as claimed in claim 1, wherein said return spring is mounted between said casing and said press portion of said operating button.

5. The blind body brake mechanism as claimed in claim 1, wherein said transmission unit comprises two guide rods respectively rotatably mounted in two opposite ends of said casing and respectively peripherally abutted against one respective said transmission cord.

* * * * *